US008848011B2

(12) United States Patent
Soltysiak et al.

(10) Patent No.: US 8,848,011 B2
(45) Date of Patent: Sep. 30, 2014

(54) APPARATUS AND METHOD FOR DISPOSING AN INKJET CARTRIDGE IN A MOUNT

(71) Applicant: R. R. Donnelley & Sons Company, Chicago, IL (US)

(72) Inventors: John R. Soltysiak, Blasdell, NY (US); Anthony V. Moscato, North Tonawanda, NY (US); Theodore F. Cyman, Jr., Grand Island, NY (US); Mark J. Muranyi, Grand Island, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 13/841,531

(22) Filed: Mar. 15, 2013

(65) Prior Publication Data

US 2013/0208060 A1 Aug. 15, 2013

Related U.S. Application Data

(63) Continuation-in-part of application No. PCT/US2012/055570, filed on Sep. 14, 2012.

(60) Provisional application No. 61/535,150, filed on Sep. 15, 2011.

(51) Int. Cl.

| | |
|---|---|
| ***B41J 25/304*** | (2006.01) |
| ***B41J 25/34*** | (2006.01) |
| ***B41J 2/175*** | (2006.01) |

(52) U.S. Cl.

CPC ..... *B41J 2/1752* (2013.01); *B41J 25/34* (2013.01)

USPC ..... 347/198; 347/197; 400/120.17

(58) Field of Classification Search

USPC ..... 347/49, 197, 198; 400/120.16, 120.17, 400/55–60, 691, 693

See application file for complete search history.

(56) References Cited

U.S. PATENT DOCUMENTS

| | | | |
|---|---|---|---|
| 4,338,610 | A | 7/1982 | Sellen et al. |
| 4,390,844 | A | 6/1983 | Ting |
| 4,530,611 | A | 7/1985 | Borcenk et al. |
| 4,594,598 | A | 6/1986 | Iwagami |
| 4,714,932 | A | 12/1987 | Reynaud |
| 4,791,434 | A | 12/1988 | Wills |
| 5,064,303 | A | 11/1991 | Ricciardi |
| 5,778,774 | A | 7/1998 | Lavoie |

(Continued)

FOREIGN PATENT DOCUMENTS

| | | |
|---|---|---|
| WO | WO 01/60627 | 8/2001 |

OTHER PUBLICATIONS

International Search Report and Written Opinion for International Application No. PCT/US2012/055570 dated Nov. 27, 2012, Applicant, Moore Wallace North America, Inc. (11 pages).

*Primary Examiner* — Anh T. N. Vo

(74) *Attorney, Agent, or Firm* — McCracken & Frank LLC

(57) ABSTRACT

An apparatus for printing using an inkjet cartridge includes a fixed top portion and first and second fixed side portions coupled to the top portion. The apparatus also includes a third side portion disposed adjacent to the first fixed side portion and adapted to receive a printhead cartridge in a fixed relation thereto. The apparatus also includes an adjustment mechanism for adjusting the position of third side portion relative to the fixed side portions.

14 Claims, 9 Drawing Sheets

(56) References Cited

U.S. PATENT DOCUMENTS

| | | | | |
|---|---|---|---|---|
| 6,095,701 | A | 8/2000 | Sattler | |
| 6,270,184 | B1 * | 8/2001 | Igarashi et al. | 347/37 |
| 6,298,783 | B1 * | 10/2001 | O'Mera et al. | 101/486 |
| 6,378,986 | B2 | 4/2002 | Van De Kruys | |
| 6,398,344 | B1 | 6/2002 | Silverbrook et al. | |
| 6,616,354 | B2 * | 9/2003 | O'Hara et al. | 400/56 |
| 6,736,498 | B2 | 5/2004 | Blum | |
| 6,796,630 | B2 * | 9/2004 | Ison et al. | 347/18 |
| 6,937,260 | B2 | 8/2005 | Williams et al. | |
| 7,005,293 | B2 | 2/2006 | DaQuino et al. | |
| 7,278,707 | B2 | 10/2007 | Silverbrook | |
| 7,401,891 | B2 | 7/2008 | Silverbrook et al. | |
| 2002/0033874 | A1 | 3/2002 | Aubin et al. | |
| 2003/0202031 | A1 | 10/2003 | Nakamura | |
| 2005/0156963 | A1 | 7/2005 | Song et al. | |
| 2009/0244124 | A1 | 10/2009 | Kondo | |
| 2009/0322825 | A1 | 12/2009 | LaBar et al. | |
| 2010/0149269 | A1 | 6/2010 | Silverbrook | |
| 2011/0102504 | A1 | 5/2011 | Wanibe | |

* cited by examiner

APPARATUS AND METHOD FOR DISPOSING AN INKJET CARTRIDGE IN A MOUNT

CROSS REFERENCE TO RELATED APPLICATIONS

The present application is a continuation-in-part of International Application No. PCT/US12/055570, with an international filing date of Sep. 14, 2012, which in turn claims benefit of Kanfoush et al., Provisional U.S. Patent Application Ser. No. 61/535,150, filed on Sep. 15, 2011. The entire contents of both of these applications are incorporated herein by reference.

BACKGROUND

1. Field of the Invention

The present invention relates generally to inkjet printing systems and more particularly to an apparatus and method for disposing an inkjet cartridge in a mount used in such systems.

2. Description of the Background of the Invention

High-speed printing systems typically include one or more imaging units. Each imaging unit has one or more inkjet cartridges (or printheads). A controller controls each inkjet cartridge to eject a fluid such as ink or other composition) onto a receiving surface. Some printing systems use an imaging unit with a moving inkjet cartridge (or an array of inkjet cartridges) that traverses the width of the receiving surface as nozzles of the inkjet cartridge drop one or more lines of fluid to form a swath of an image along the width of the receiving surface. Upon completion of the swath, the receiving surface is advanced in accordance with the width of the swath and the inkjet cartridge again traverses the width of the receiving surface to print a next swath of the image.

Other printing systems use an imaging unit with a fixed inkjet cartridge (or an array of inkjet cartridges) in which the receiving surface is moved under the inkjet cartridge and nozzles of the inkjet cartridge eject drops of fluid onto the receiving surface in accordance with the position of the receiving surface to print an image. Inkjet cartridges are interfaced with a controller that controls the formation and ejection of drops from the inkjet cartridge when such drops are needed. In addition, inkjet cartridges may be connected using fluid conduits to ink supplies that provide ink and/or other fluids to the inkjet cartridge to replenish any ink ejected and/or otherwise removed (e.g., by evaporation) therefrom.

In a printing system, an inkjet cartridge is disposed in a carrier such that the nozzles of the inkjet cartridge are directed toward the receiving surface. The carrier may be manufactured from steel or other alloys that can be milled to a high precision. More than one inkjet cartridge may be disposed in a carrier in this fashion in a one or two-dimensional array.

In some print systems, a mount is secured to a carrier and the inkjet cartridge is disposed in the mount. In some cases the inkjet cartridge may be removed from the mount, for example, for maintenance or replacement, without removing the mount from the carrier. In addition, some mounts may include adjustment mechanisms that allow adjustment of the position of the inkjet cartridge with respect to the mount and the carrier without removing the inkjet cartridge from the mount or the mount from the carrier.

SUMMARY OF THE INVENTION

According to one aspect of the present invention a mount for holding a printhead cartridge includes a top portion and first and second side portions fixedly secured to the top portion. The mount also includes a third side portion disposed adjacent to the first side portion and an adjustment mechanism. The third side portion is adapted to receive a printhead cartridge in a fixed relation thereto. The adjustment mechanism is operable to adjust the position of the third side portion relative to the first and second side portions.

According to another aspect of the present inventions a method of securing a printhead cartridge to a carrier plate includes the steps of securing a mount to the carrier plate, wherein the mount comprises first and second side portions fixedly secured to a top portion and a flexible portion attached to the first side portion. The method also includes the steps of securing the inkjet cartridge to the flexible portion and operating an adjustment mechanism to move the inkjet cartridge relative to the first and second side portions.

Other aspects and advantages of the present invention will become apparent upon consideration of the following detailed description

DETAILED DESCRIPTION OF THE PREFERRED EMBODIMENTS

Figure 1:
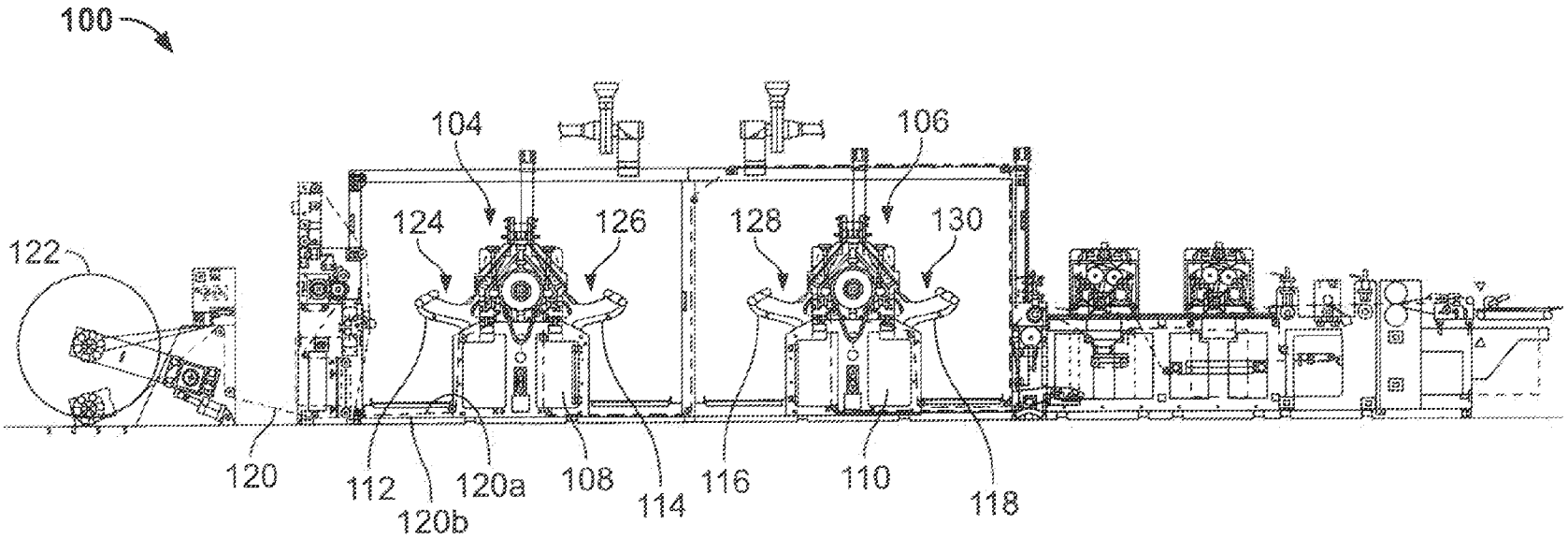
FIG. 1 is a side elevational view with portions removed of a printing system of the present invention.

FIG. 1 comprises a side elevational view of a printing system 100 that includes a first imaging unit 104, a second imaging unit 106, a first dryer 108, and a second dryer 110. In the printing system 100, the imaging unit 104 includes carriers 112 and 114 onto which inkjet cartridges may be secured. Similarly, the second imaging unit 106 includes carriers 116 and 118 onto which inkjet cartridges may be secured. The carriers 112, 114, 116, and 118 are shown in an open, non-printing position in FIG. 1. A receiving surface 120 may be transported through the printing system 100 such that the first imaging unit 104 prints ink(s) on a front side 120*a* and the second imaging unit 106 prints ink(s) on the reverse side 120*b* thereof. The receiving surface 120 may comprise a web, sheet, or belt of paper or other material, as desired. In the illustrated embodiment, a web from a roll 122 and is supplied to the imaging units 104, 106. In other embodiments, a web of paper from a roll 122 is supplied to the imaging units 104, 106.

In the printing system 100 of FIG. 1, each print unit 104 and 106 has leading and trailing portions. In particular, the print unit 104 has a leading portion 124 at which the carrier 112 is disposed and a trailing portion 126 at which the carrier 114 is disposed. Similarly, the print unit 106 has leading and trailing portions 128 and 130 at which carriers 116 and 118 are disposed, respectively.

The dryers 108 and 110 may be used to thy ink(s) or other fluids deposited by the inkjet cartridges of the first and second imaging units 104 and 106, respectively.

Figure 2B:
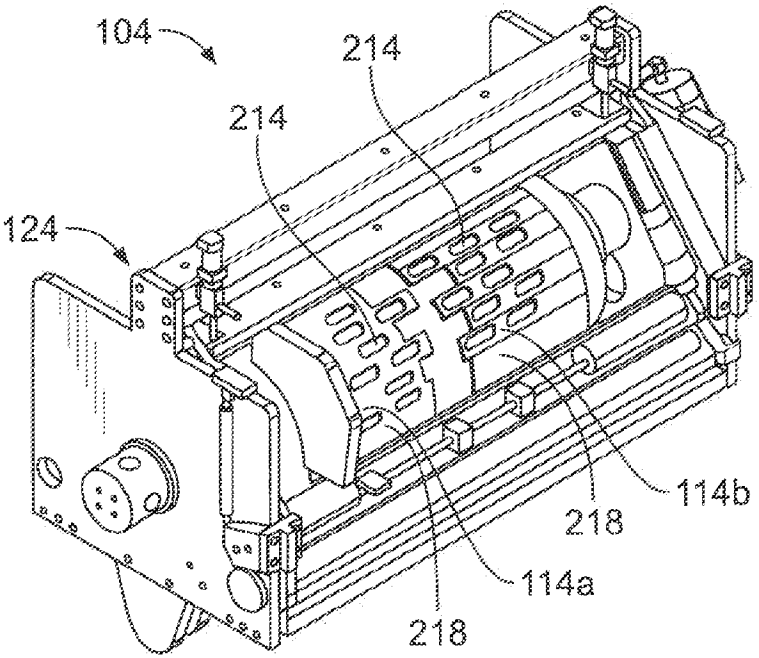
FIGS. 2A and 2B are isometric views of an imaging unit of the printing system of FIG. 1.
Figure 2A:
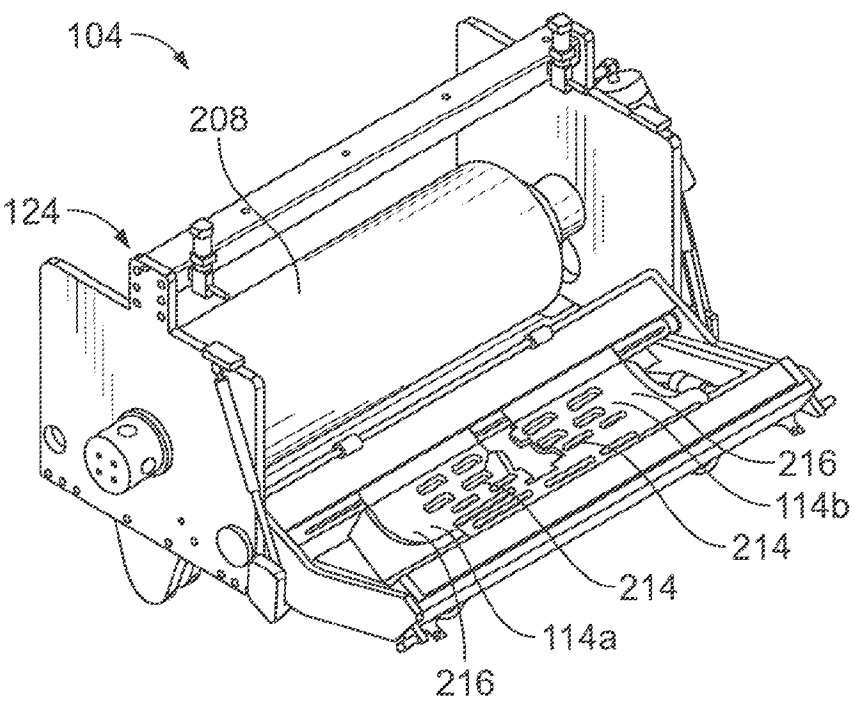

FIGS. 2A and 2B show a portion of an embodiment of the imaging unit 104 that includes a drum 208 and carriers 114*a* and 114*b*. FIG. 2A shows the carriers 114 in an open, non-printing position and FIG. 2B shows the carriers 114 in a closed, printing position. The carrier 114 includes apertures in the form of slots 214 into each of which an inkjet cartridge may be disposed and secured by a mount (described hereinafter). During operation, the receiving surface 120 is transported about the drum 208. In some embodiments, a motor drives the drum 208 so that rotation of the drum 208 assists in transporting the receiving surface 120.

The inkjet cartridges (not shown) disposed in the slots 214 of the carriers 114*a* and 114*b* print on the same side of the receiving surface. The slots 214 are arranged in the carriers 114*a* and 114*b* in a two-dimensional pattern. The inkjet cartridges disposed on the slots 214 of the carriers 114*a* and 114*b* print, for example, on the left-hand and right-hand portions, respectively, of a side 120*a* of the receiving surface 120. It should be apparent that the carriers 114*a* and 114*b* may be replaced by a single carrier or three or more carriers, wherein the single or multiple carriers together or individually span a width similar or identical to the combined width of the carriers 114*a* and 114*b*. Additional inkjet cartridges are mounted on carriers (not shown) similar or identical to the carriers 114*a* and 114*b* that are disposed on or adjacent the other portion 214 of the imaging unit 104. Each carrier 114*a* and 114*b* has a bottom surface 216 and a top surface 218. In the closed position, the bottom surfaces 216 face toward the drum 208, and therefore, toward the receiving surface 120 transported about such drum 208, and the top surfaces face away from the drum 208 and the receiving surface 120. As seen in FIG. 2B, in the closed position, nozzles of the inkjet cartridges disposed in slots 214 face the drum 208 and the receiving surface 120, and the receiving surface 120 is transported between the drum 208 and such nozzles.

Figure 3A:
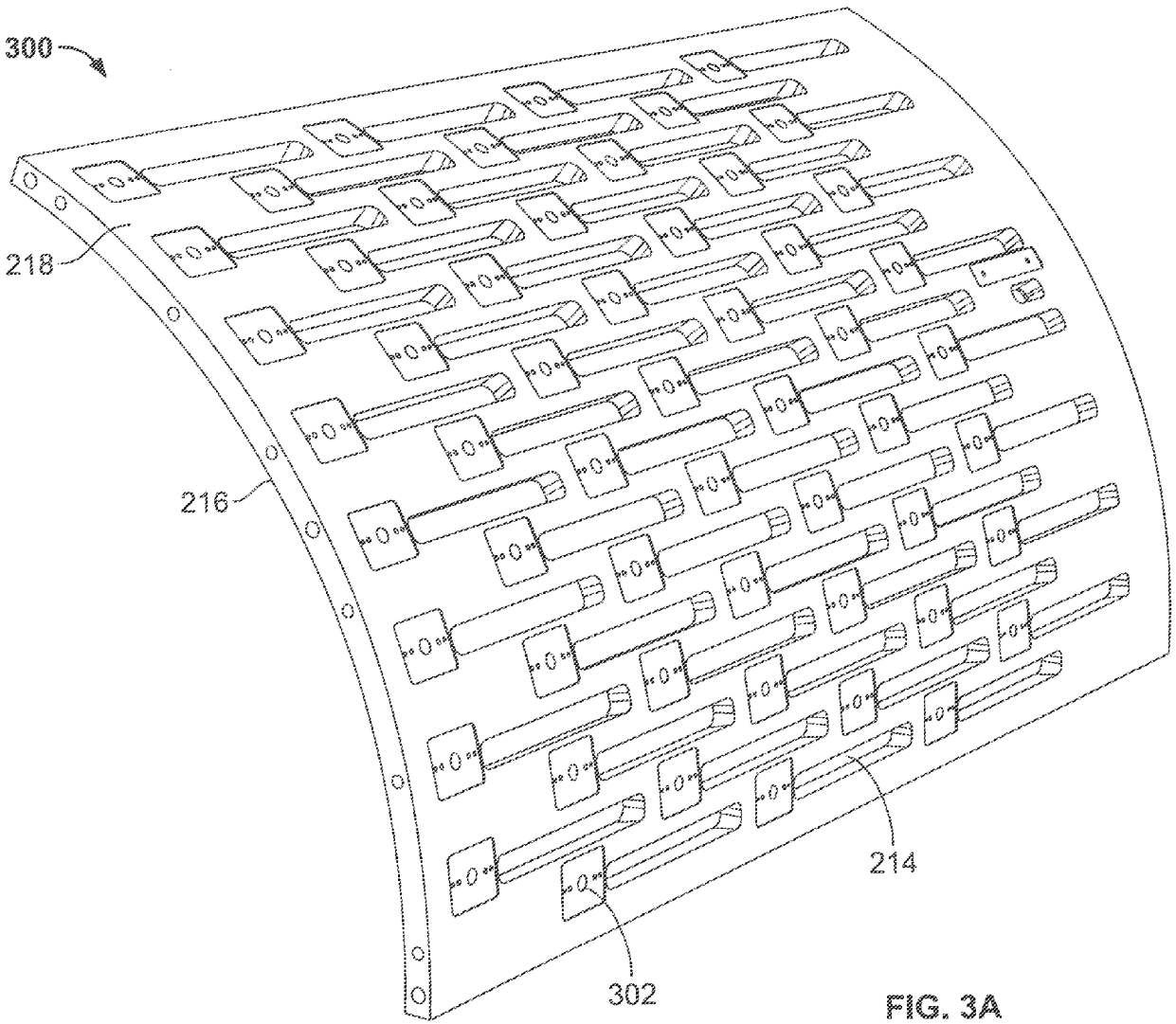
FIGS. 3A and 3B are isometric views of a carrier plate used in the printing system of FIG. 1.
Figure 3B:
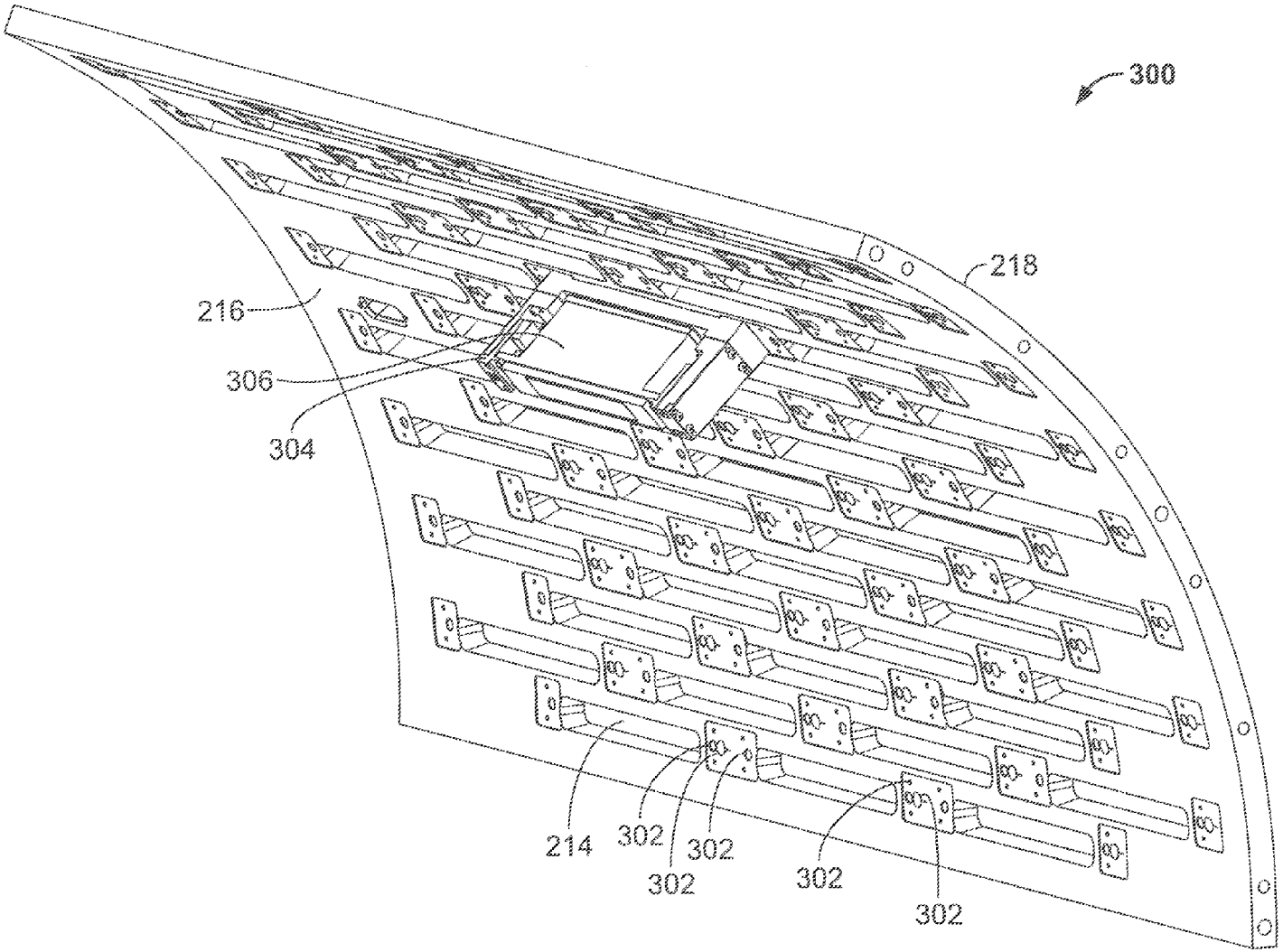

FIGS. 3A and 3B are isometric views of a top surface 218 and a bottom surface 216 of a carrier 114. The pattern in which the slots 214 are arranged in the carrier 300 is different than the pattern in which the slots 214 arranged in the carriers 114*a* and 114*b*. It should be apparent that the slots 214 may be arranged in other two-dimensional patterns.

The carrier 300 includes apertures and/or indents 302 through with elements of a mount 304 secured into a slot 214 may extend into and/or pass through. The apertures 302 may be used to accommodate one or more screws that secure the mount to the carrier 300. The indents 302 may provide datum surfaces that aid in aligning the mount 304 with respect to the slot 214 in the carrier 300. The carrier 300 may be an arcuate plate as shown in FIGS. 3A and 3B or a flat plate. FIG. 3B also shows an inkjet cartridge 306 disposed in the mount 304. The mount 304 is secured to the carrier plate 300 and the inkjet cartridge 306 is secured to the mount 304 as described hereinbelow.

Figure 4A:
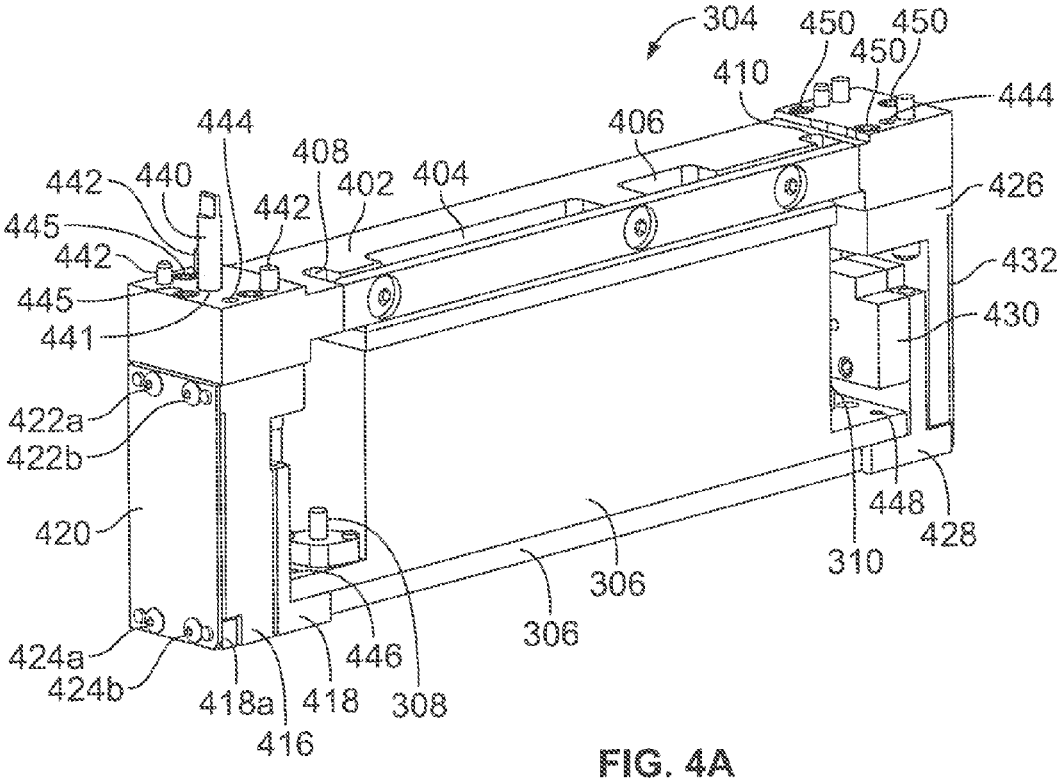
FIGS. 4A and 4B are isometric views of a mount that is used to secure an inkjet cartridge to the carrier plate of FIGS. 3A and 3B.
Figure 4B:
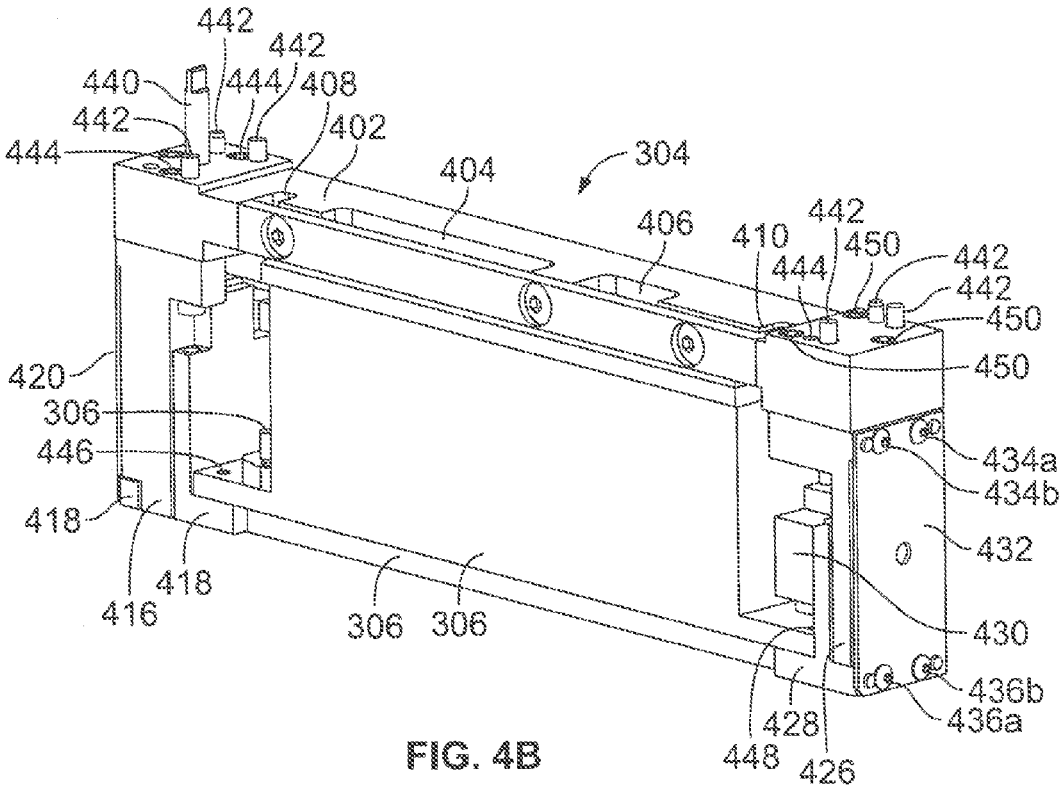

FIGS. 4A and 4B are isometric views of the mount 304 and an inkjet cartridge 306 disposed therein. The inkjet cartridge 306 includes a port 308 that may be connected to a fluid supply (such as ink). Ink or other fluid flushed from the inkjet cartridge 306, for example, to change ink colors or to clean the inside of such cartridge, may be discharged from a port 310. A fluid line may be connected to the port 310 to carry such fluid therefrom to a waste receptacle.

The mount 304 includes a top portion 402 that has apertures 404, 406, 408, and 410. The apertures 404, 406, 408, and 410 are aligned with the slot 214 of the carrier 300 when the mount 304 is secured thereto. A fluid line (not shown) may be passed through the slot 214 and through the apertures 408 and/or 410 and connected to the ports 308 and/or 310, respectively. Data and power sources (not shown) may be passed through the slot 214 and through the apertures 404 and 406 and connected to data and power ports (not shown), respectively, of the inkjet cartridge 306.

At a first end thereof, the mount 402 includes a wedge base assembly 416, a wedge block assembly 418, and a first flex plate 420. The wedge base assembly 416 is secured to the top portion 402 of the mount. The first flex plate 420 is secured to the wedge base assembly 416 by screws 422*a* and 422*b*. The first flex plate 420 is also secured to the wedge block assembly 418 by screws 424A and 424B. In particular, the screws 424A and 424B secure the first flex plate 420 to a portion 418-A of the wedge block assembly 418.

At a second end opposite the first end, the mount 402 includes a spring base assembly 426, a spring block assembly 428, a spring stop 430, and a second flex plate 432. The spring base assembly 426 is secured to the top portion 402 of the mount 304. The second flex plate is attached to the spring base assembly 426 by screws 434*a* and 434*b*. The second flex plate is also secured to the spring block assembly 428 by screws 436*a* and 436*b*. The spring stop 430 is secured to the spring block assembly 428 by screws as will be described below.

The inkjet cartridge 306 is secured to the wedge block assembly 418 by screws fastened through such assembly and into a threaded aperture 446 and another threaded aperture (not shown) at the rear of the mount 402. The inkjet cartridge 306 is similarly attached to spring block assembly 428 by screws fastened through such assembly into a threaded aperture 448 and another threaded aperture (not shown) at the rear of the mount 402.

The wedge base assembly 416 includes a post 440 that extends upward therefrom. The post 440 passes through an aperture 441 in the top portion 402 of the mount 304 and may be passed through one of the apertures 302 in the carrier 300.

The top portion 402 of the mount 304 includes protrusions 442 that may be inserted into or aligned with the apertures and/or indents 302 of the carrier 300. In addition the top portion 402 includes threaded apertures 444 that may be aligned with the apertures 302 of the carrier 300. A screw may be passed through such an aperture 302 and fastened into the threaded aperture 444 aligned thereto. Screws 445 pass through apertures in the top portion 402 and into threaded apertures (described below) of the wedge base assembly 416 to secure the top portion 402 to the wedge base assembly 416. Screws 450 pass through apertures in the top portion 402 and into threaded apertures (described below) of the spring base assembly 426 to secure the top portion 402 to the spring base assembly 426.

Figure 5C:
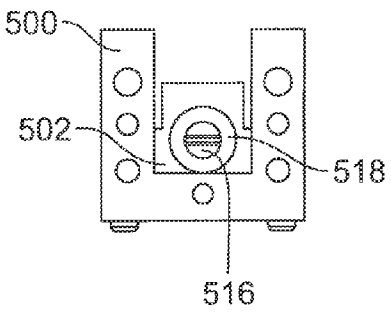
FIG. 5C is a top planar view of the portion of the mount of FIGS. 5A and 5B.
Figure 5B:
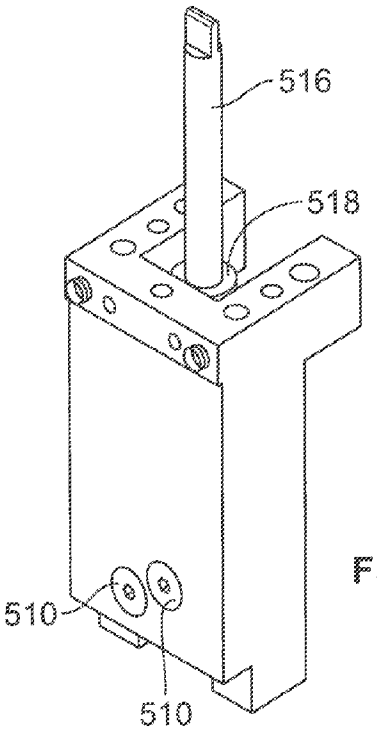
FIGS. 5A and 5B are isometric views of a portion of the mount of FIGS. 4A and 4B.
Figure 5A:
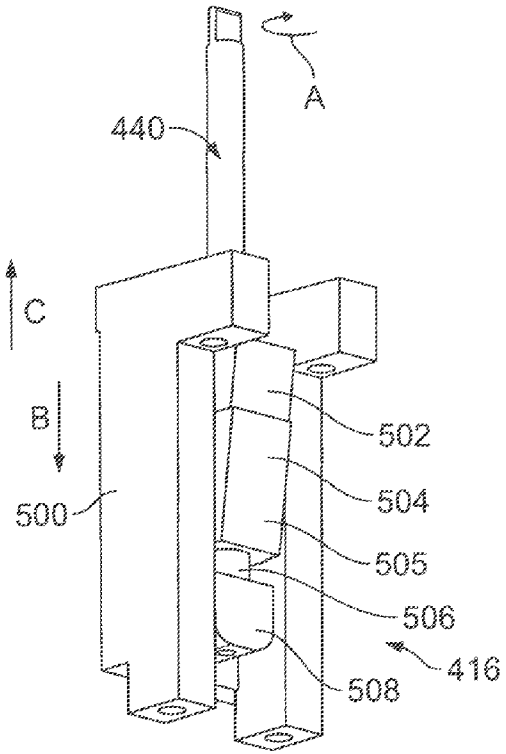

FIGS. 5A and 5B show isometric views of the wedge base assembly 416 and FIG. 5C shows a top planar view of the wedge base assembly 416. The wedge base assembly 416 includes a wedge base 500, a wedge nut 502, a wedge 504, a compression spring 506, and a wedge center block 508. The wedge 504 has an angular face 505. The wedge center block 508 is secured to the wedge base by screws 510.

Figure 6:
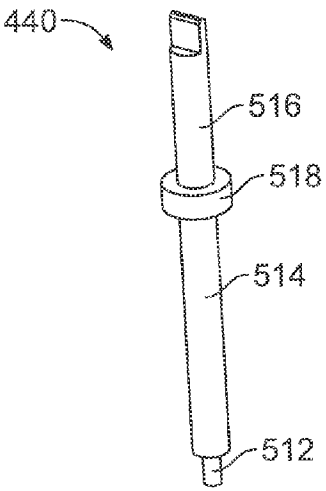
FIG. 6 is an isometric view of a post of the portion of the mount of FIGS. 5A and 5B.

FIG. 6 shows an isometric view of the post 440. The post 440 includes a bottom portion 512, a central portion 514 that is threaded, and a top portion 516. An annular disc 518 separates the central portion 514 and the top portion 516.

Returning to FIG. 5A, the post 440 is threaded through wedge nut 502, passed through the wedge 504, and the compression spring 506 and into the wedge center block 508. The wedge center block 508 includes a hole to receive the bottom portion 512 of the post 440. As the post 440 is turned in the direction A, the wedge nut 502 pushes wedge 504 in the direction B towards the compression spring 506. As the post 440 is turned counter to the direction A, the compression spring pushes the wedge nut 502 and the wedge 504 in the direction C until the wedge nut 502 contacts the annular disc 518.

Figure 7B:
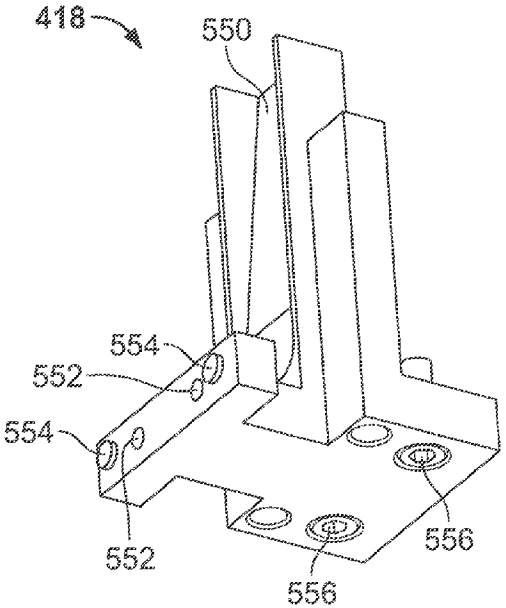
FIGS. 7A and 7B are isometric views of another portion of the mount of FIGS. 4A and 4B.
Figure 7C:
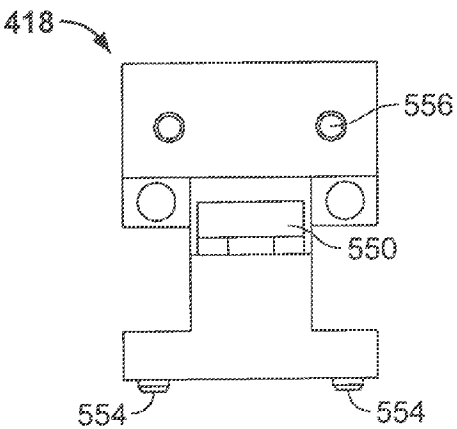
FIG. 7C is a top planar view of the portion of the mount of FIGS. 7A and 7B.
Figure 7A:
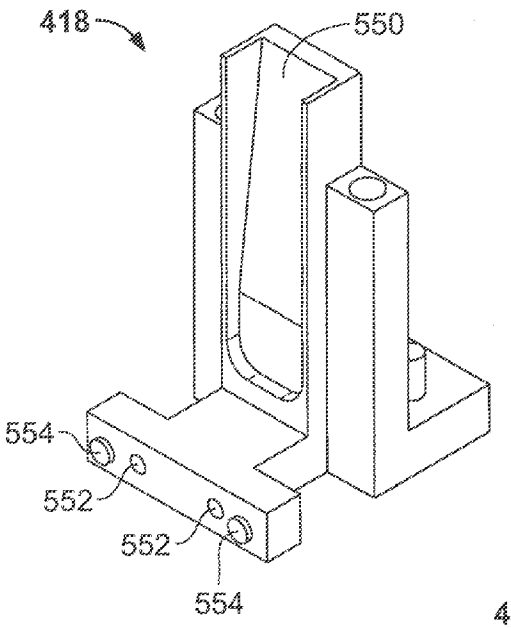

FIGS. 7A and 7B show isometric views of the wedge block assembly 418. FIG. 7C shows a top planar view of the wedge block assembly 418. The wedge block assembly 418 includes an angular face 550. When the wedge base assembly 416 and the wedge block assembly 418 are disposed in the mount as shown in FIGS. 4A and 4B and affixed to the first flexible plate 420 as described above, at least a portion of the angular face 550 abuts at least a portion of the angular face 505 of the wedge 504.

The wedge block assembly 418 includes screw holes 556. A screw may be passed through the aperture 556 and into the aperture 446 of the inkjet cartridge 306, thereby securing the inkjet cartridge 306 to the wedge block assembly 418. The wedge block assembly 418 also includes screw receiving apertures 552 into which screws 424 may be fastened to secure the first flex plate 420 to the wedge block assembly 418. Protrusions 554 extend from the wedge block assembly 418 that may be used to provide datum surfaces to align the first flex plate 420 and the wedge block assembly 418.

Figure 8B:
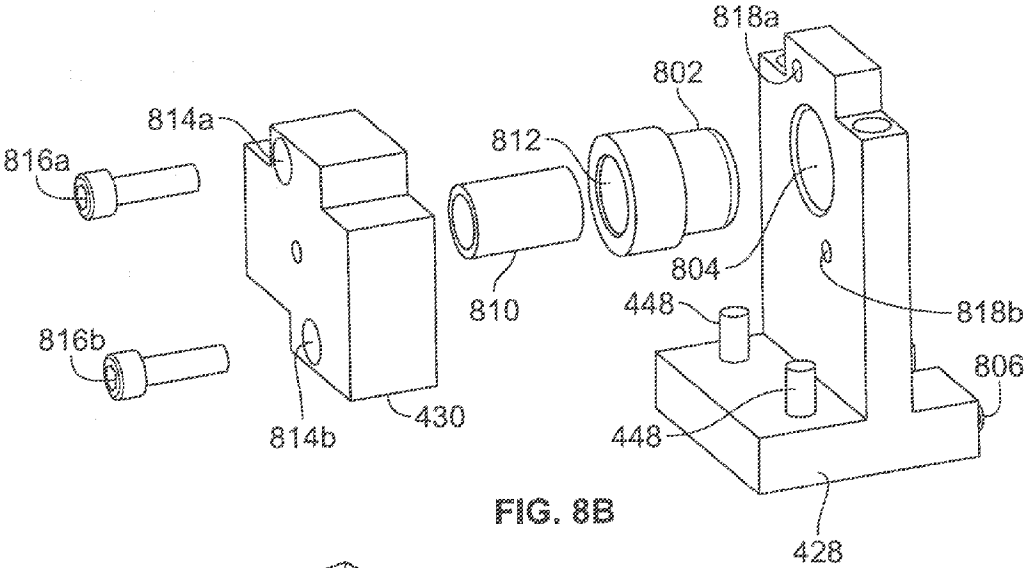
FIG. 8B is an exploded view of the portion of the mount of FIG. 8A.
Figure 8A:
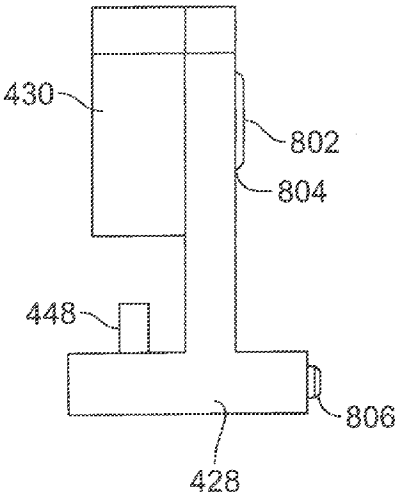
FIG. 8A is a side elevations view of still another portion of the mount of FIGS. 4*a* and 4B.

FIG. 8A shows a side elevational view of the spring block assembly 428 and a spring stop 430 of the mount 304. A compression spring (not shown in FIG. 8A) and a spring retainer 802 are disposed in the spring stop 430 such that a portion of the spring retainer 802 passes through an aperture 804 of the spring block assembly 428 and extends outwards therefrom. The spring stop includes protrusions 806 that extend outwardly therefrom that provide datum surfaces to align the second flex plate 432 with the spring block assembly 428.

Figure 8D:
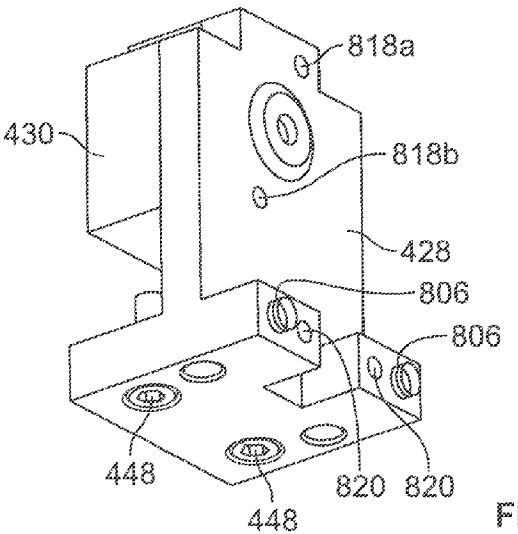
FIG. 8D is an isometric view of the portion of the mount of FIG. 8A.
Figure 8C:
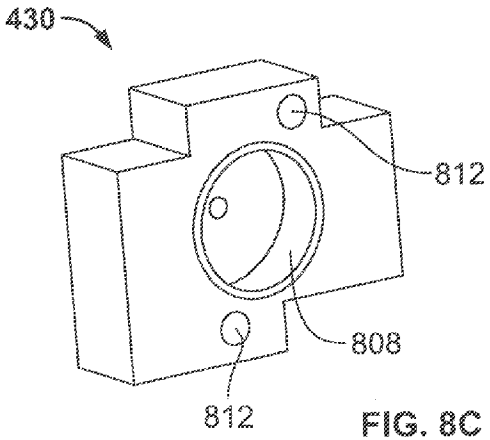
FIG. 8C is an isometric view of an element of the portion of the mount of FIG. 8B.

FIG. 8B shows an exploded view of the spring block assembly 428 and the spring stop 430 and FIG. 8C shows an isometric view of the spring stop 430. FIG. 8D shows an isometric view of the spring block assembly 428. A compression spring 810 is disposed in a cavity 812 of the spring retainer 802. The spring retainer 802 is thereafter disposed in a cavity of the spring stop 430 so that the compression spring is substantially enclosed between the spring stop 430 and the spring retainer 802. The spring stop includes apertures 814*a* and 814*b* through which screws 816*a* and 816*b*, respectively, pass into threaded apertures 818*a* and 818*b*, respectively, of the spring block assembly 428, thereby securing the spring stop 430 to the spring block assembly 428.

Figure 9B:
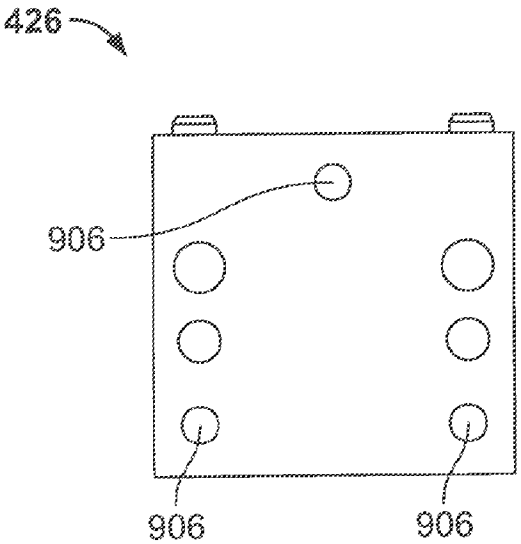
FIG. 9B is a top planar view of the portion of the mount of FIG. 9A.
Figure 9A:
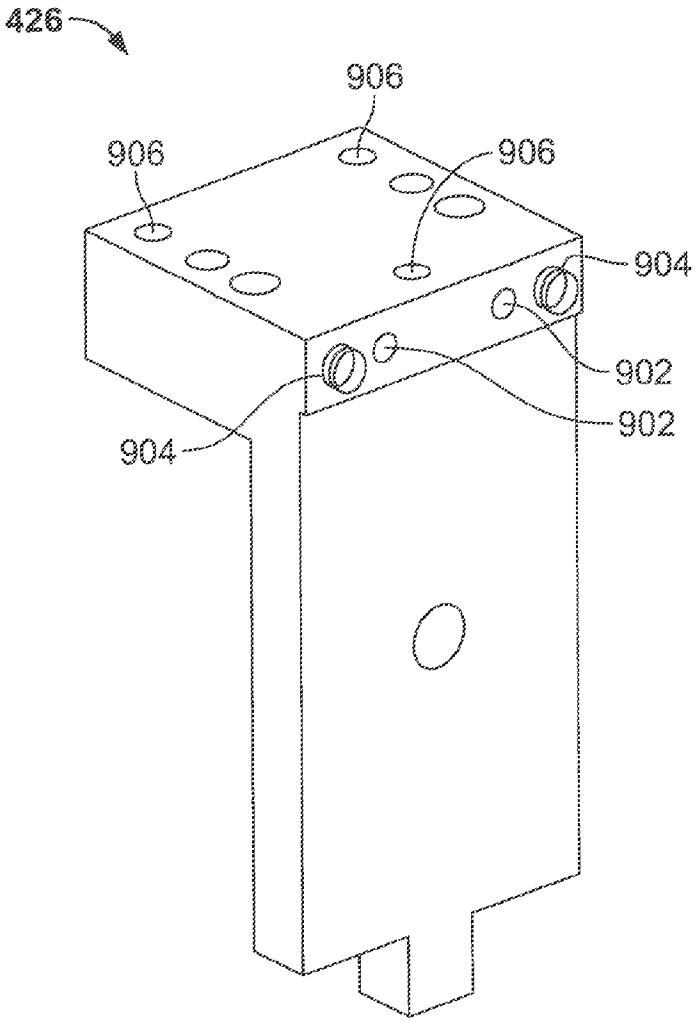
FIG. 9A is an isometric view of yet another portion of the mount of FIGS. 4A and 4B.

FIG. 9A shows an isometric view and FIG. 9B shows a top planar view of the spring base assembly 426. The spring base assembly 426 includes threaded apertures 902 for receiving the screws 434 that secure the second flex plate 432 to the spring base assembly 426. In addition, the spring base assembly 426 includes apertures 906 for receiving screws that secure the spring base assembly 426 to the top portion 402 of the mount 304.

Referring once again to FIGS. 4A and 5A, when the post 440 is turned in a direction A so that the wedge 504 is moved in the direction B, the abutment of angular faces 550 and 505 urges the wedge block assembly 418 and the inkjet cartridge 306 secured thereto away from the wedge base assembly 416 (and toward the spring base assembly 426). Similarly, turning the post 440 in a direction counter to A so that the wedge 504 in moved in the direction C, the compression spring urges the wedge block assembly 418 and the inkjet cartridge 306 towards the wedge base assembly 416. In this fashion, the position of the inkjet cartridge 306 relative to the top portion 402, the wedge base assembly 416, and/or the spring base assembly 426 may be adjusted while the cartridge remains secured in the mount. The top portion 402, the wedge base assembly 416, and the spring base assembly 426 remain fixed relative to one another. Adjusting the position of the cartridge may be useful, for example, to align inkjet cartridges mounted to the carrier 300 relative to one another to stitch an image therebetween.

The post 440 may be turned manually by an operator by a motor, for example, a step motor, operated by a controller.

The first and second flex plates 420 and 432 are made of a sufficiently flexible material to allow the movement of the wedge block assembly 418 described above. Such flex plates may be manufactured from steel or other metal allows, metals, or polymers. The other components of the mount 304 are manufactured from known durable materials including steel or other metal alloys, metals, and/or polymers.

INDUSTRIAL APPLICABILITY

The apparatus and method disclosed herein may be utilized to position and dispose an inkjet cartridge in a mount therefor. The mount is designed to allow the position of the inkjet cartridge to be adjusted without having to remove the inkjet cartridge from the mount. Further, various modifications may be apparent to enhance the efficacy of mounting inkjet cartridges. Still further, the apparatus disclosed herein is easily scalable to be utilized with a wide variety of sizes, types, and configurations of printing systems. In addition, the apparatus and method described herein may be used in applications in which a first body is secured to a second body and the position of the first body needs to be modified after such securing.

Numerous modifications to the present invention will be apparent to those skilled in the art in view of the foregoing description. Accordingly, this description is to be construed as illustrative only and is presented for the purpose of enabling those skilled in the art to make and use the disclosure and to teach the best mode of carrying out the same. The exclusive right to all modifications within the scope of this disclosure is reserved.

We claim:

1. A mount for holding a printhead cartridge comprising:

a top portion;

first and second side portions fixedly secured to the top portion;

a third side portion disposed adjacent to the first side portion and adapted to receive a printhead cartridge in a fixed relation thereto;

a flexible member having a first segment and a second segment, wherein the first segment is secured to the first side portion and the second segment is secured to the third side portion; and an adjustment mechanism operable to adjust the position of the third side portion relative to the first and second side portions, wherein operation of the adjustment mechanism causes the third side portion and the second segment of the flexible member to move relative to the first and second side portions, while the first segment of the flexible member remains substantially fixed.

2. The mount of claim 1, wherein the first side portion is disposed between the third side portion and the flexible member.

3. The mount of claim 1, wherein the flexible member comprises a flexible plate.

4. The mount of claim 1, wherein a first wedge is disposed between the first side portion and the third side portion.

5. The mount of claim 4, wherein, operating the adjustment mechanism causes the wedge to move in a first direction and the third side portion to move in a second direction perpendicular to the first direction.

6. The mount of claim 5, wherein moving the wedge in the first direction causes the wedge to move toward to or away from the top portion.

7. The mount of claim 1, wherein the top portion is secured to a carrier plate.

8. The mount of claim 1, wherein the top portion includes an aperture through which a fluid line may be passed.

9. The mount of claim 1, in combination with a printhead cartridge secured to the third side portion.

10. A method of securing a printhead cartridge to a carrier plate, comprising the steps of:

securing a mount to the carrier plate, wherein the mount comprises first and second side portions fixedly secured to a top portion and a flexible member having a first segment attached to the first side portion;

securing the inkjet cartridge to a second segment of the flexible member; and operating an adjustment mechanism to move the inkjet cartridge and the second segment of the flexible member relative to the first and second side portions while the first segment of the flexible member remains substantially fixed.

11. The method of claim 10, wherein a wedge is disposed between the first side portion and the inkjet cartridge and the step of operating includes the step moving the wedge in a direction substantially perpendicular to the direction in which the inkjet cartridge is moved.

12. The method of claim 11, wherein the step of moving the wedge includes the step of moving the wedge towards or away from the top portion.

13. The method of claim 10, wherein the step of securing the mount comprises the step of securing the mount to the carrier plate.

14. The method of claim 10, wherein comprising the step of the securing the flexible member to the first side portion.

* * * * *